US010553160B2

(12) United States Patent
Shen et al.

(10) Patent No.: US 10,553,160 B2
(45) Date of Patent: Feb. 4, 2020

(54) DISPLAY PANEL AND DRIVING METHOD THEREOF

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Lixia Shen, Beijing (CN); Zhiguang Zhang, Beijing (CN); Chang Zhang, Beijing (CN); Yong Yu, Beijing (CN); Tae Hyun Kim, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 57 days.

(21) Appl. No.: 15/781,663

(22) PCT Filed: Nov. 23, 2017

(86) PCT No.: PCT/CN2017/112540
§ 371 (c)(1),
(2) Date: Jun. 5, 2018

(87) PCT Pub. No.: WO2018/214432
PCT Pub. Date: Nov. 29, 2018

(65) Prior Publication Data

US 2019/0378457 A1 Dec. 12, 2019

(30) Foreign Application Priority Data

May 26, 2017 (CN) ..... 2017 1 0389106

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2320/0233* (2013.01)

(58) Field of Classification Search
USPC ..... 345/690
See application file for complete search history.

(56) References Cited

U.S. PATENT DOCUMENTS

2003/0122813 A1* 7/2003 Ishizuki ..... G09G 3/3233 345/211
2006/0022969 A1* 2/2006 Lee ..... G02F 1/136286 345/211

(Continued)

FOREIGN PATENT DOCUMENTS

CN 101697268 A 4/2010
CN 103996374 A 8/2014

(Continued)

OTHER PUBLICATIONS

PCT International Search Report, Application No. PCT/CN2017/112540, dated Feb. 24, 2018, 10 pages: with English translation.

(Continued)

*Primary Examiner* — Chineyere D Wills-Burns
(74) *Attorney, Agent, or Firm* — Armstrong Teasdale LLP

(57) ABSTRACT

Embodiments of the present disclosure provide an OLED display panel and a driving method thereof. The OLED display panel includes a plurality of power lines, each power line connecting to a plurality of pixels, and one end of each power line connecting to a power source. The method includes acquiring a current value of the power line and comparing it to a preset threshold, when a current value of the power line is less than or equal to the threshold, providing an original data voltage to the pixels connected to (Continued)

the power line, when a current value of a power line is greater than the threshold, providing a compensating data voltage to the pixel connected to the power line. The compensating data voltage is equal to the difference between the original data voltage and the compensation voltage.

10 Claims, 2 Drawing Sheets

(56) References Cited

U.S. PATENT DOCUMENTS

2009/0262258 A1* 10/2009 Taneda ..... G09G 3/3233 348/739
2011/0018787 A1* 1/2011 Nakamura ..... G09G 3/3233 345/76
2012/0236041 A1* 9/2012 Oh ..... G09G 3/3258 345/690
2012/0249514 A1* 10/2012 Ahn ..... G09G 3/3233 345/212
2014/0009446 A1* 1/2014 Lee ..... G09G 3/3208 345/204
2014/0152643 A1* 6/2014 Kim ..... G09G 3/3258 345/212
2017/0032742 A1* 2/2017 Piper ..... G09G 3/3233
2017/0162124 A1* 6/2017 Kuo ..... G09G 3/3283
2018/0061321 A1* 3/2018 Hong ..... G09G 3/3241

FOREIGN PATENT DOCUMENTS

CN 104821152 A 8/2015
CN 106128359 A 11/2016
CN 107180613 A 9/2017

OTHER PUBLICATIONS

PCT Written Opinion, Application No. PCT/CN2017/112540, dated Feb. 24, 2018, 6 pages.: with English translation of relevant part.

* cited by examiner

DISPLAY PANEL AND DRIVING METHOD THEREOF

CROSS REFERENCE TO RELATED APPLICATIONS

This patent application is a National Stage Entry of PCT/CN2017/112540 filed on Nov. 23, 2017, which claims the benefit and priority of Chinese Patent Application No. 201710389106.9 filed on May 26, 2017, the disclosures of which are incorporated herein by reference in their entirety as part of the present application.

BACKGROUND

The present disclosure belongs to the field of display technologies, and in particular, relates to a display panel and a driving method thereof.

An organic light emitting diode (OLED) for light emission display is provided in each pixel of an OLED display panel. The anode of the OLED is connected to a power supply voltage, and the cathode thereof is grounded, so as to provide a necessary voltage difference for light emission. Each power line is connected to a plurality of pixels, and one end thereof is connected to a power source to supply the power supply voltage to the pixels via the power line. In general, the light emission luminance of the OLED is controlled by the current of the driving transistor in the pixel, and the current is controlled by the data voltage of the gate of the driving transistor, whereby the luminance of the pixel can be controlled by adjusting the data voltage.

BRIEF DESCRIPTION

Embodiments of the present disclosure provide a display panel and a driving method thereof.

A first aspect of the present disclosure provides a method for driving a display panel. The display panel includes a plurality of power lines, each power line connecting to a plurality of pixels, and one end of each power line connecting to a power source. The method for driving the display panel includes acquiring a current value of the power line, wherein the current value is a value of current in a portion of the power line between the power source and a first pixel, which is a closest pixel, among all pixels connected to the power line, to the power source, comparing the acquired current value to a preset threshold, and providing an original data voltage to the pixels connected to the power line in the case that the current value of the power line is less than or equal to the threshold, providing a compensation data voltage to the pixels connected to the power line in the case that the current value of the power line is greater than the threshold, wherein the compensation data voltage is equal to the difference between the original data voltage and the compensation voltage, wherein in the case of the same current value, the compensation voltage corresponding to a pixel with a greater equivalent distance, which is a distance from the pixel along the track of the power line connected thereto to the power source, is greater.

In an embodiment of the present disclosure, the current value is an average value of the current in a portion of the power line between the power source and the first pixel for a frame of a picture. Providing the original data voltage to the pixels connected to the power line includes providing the original data voltage to all pixels connected to the power line for a next frame of the picture. Providing the compensation data voltage to the pixels connected to the power line includes providing the compensation data voltage to all pixels connected to the power line for the next frame of the picture.

In an embodiment of the present disclosure, the current value is a real-time value of current in the power line, and the pixels connected to the power line are respectively connected to different gate lines. Providing the original data voltage to the pixels connected to the power line includes providing the original data voltage to next pixel connected to the power line. Providing the compensation data voltage to the pixels connected to the power line includes providing the compensation data voltage to the next pixel connected to the power line.

In an embodiment of the present disclosure, the current value is obtained by calculating according to a grayscale value of the pixel connected to the power line. Alternatively, the current value is obtained by detection.

In an embodiment of the present disclosure, the compensation voltage $\Delta Vi$ corresponding to the pixel i is calculated according to the following equation: $\Delta Vi=I\times di\times\rho/A$. I is the current value of the power line connected to the pixel i, di is the equivalent distance corresponding to the pixel i, $\rho$ is the resistivity of a material of the power line, and A is cross-sectional area of the power line.

In an embodiment of the present disclosure, the power line is arranged in a column direction, and the pixels connected thereto are located in a plurality of different rows. The compensation voltage $\Delta Vi$ corresponding to the pixel i is calculated according to the following equation: $\Delta Vi=I\times[R1+\Delta R\times(n-1)]$. I is the current value of the power line connected to the pixel i, R1 is the resistance of the power line between a first row of pixels and the power source, $\Delta R$ is a resistance of the power line between two adjacent rows of pixels, and n is a serial number of the row of the pixel i.

A second aspect of the present disclosure provides a display panel. The display panel includes a plurality of power lines, each power line connecting a plurality of pixels, one end of each power line connecting to a power source, a current acquisition unit, configured to acquire a current value of a power line, wherein the current value is a value of current in a portion of the power line between the power source and a first pixel, which is a closest pixel, among all pixels connected to the power line, to the power source, a comparison unit, configured to compare the acquired current value to a preset threshold, a data voltage supply unit, configured to provide an original data voltage to the pixels connected to the power line in the case that the current value of the power line is less than or equal to the threshold, and provide a compensation data voltage to the pixels connected to the power line in the case that the current value of the power line is greater than the threshold. The compensation data voltage is equal to the difference between the original data voltage and the compensation voltage. In the case of the same current value, the compensation voltage corresponding to a pixel with a greater equivalent distance, which is a distance from the pixel along the track of the power line connected thereto to the power source, is greater.

In an embodiment of the present disclosure, the current value is an average value of the current in a portion of the power line between the power source and the first pixel for a frame of a picture. The data voltage supply unit is configured to provide the original data voltage to all pixels connected to the power line for a next frame of the picture in the case that the current value of the power line is less than or equal to the threshold. The data voltage supply unit is configured to provide the compensation data voltage to all pixels connected to the power line for the next frame of the picture in the case that the current value of the power line is greater than the threshold.

In an embodiment of the present disclosure, the current value is a real-time value of current in the power line, and the pixels connected to the power line are respectively connected to different gate lines. The data voltage supply unit is configured to provide the original data voltage to a next pixel connected to the power line in the case that the current value of the power line is less than or equal to the threshold. The data voltage supply unit is configured to provide the compensation data voltage to the next pixel connected to the power line in the case that the current value of the power line is greater than the threshold.

In an embodiment of the present disclosure, the current acquisition unit includes a current calculation module, configured to calculate the current value according to the grayscale value of the pixel connected to the power line, or a current detection module, configured to detect the current value of the power line.

BRIEF DESCRIPTION OF THE DRAWINGS

In order to illustrate the technical solution of the present disclosure more clearly, the drawings of the embodiments will be briefly described below. It should be appreciated that the drawings described below are merely some of the embodiments of the present disclosure, rather than limiting the scope of the present disclosure, in which.

DETAILED DESCRIPTION

In order to make the technical solutions and advantages of the embodiments of the present disclosure clearer, the technical solutions of the embodiments of the present disclosure will be clearly and completely described below in conjunction to the accompanying drawings. Apparently, the described embodiments are only a part rather than all of the embodiments of the present disclosure. All other embodiments obtained by those of ordinary skill in the art based on the described embodiments without creative efforts shall also fall within the scope of the present disclosure.

Herein, unless specifically stated otherwise, the expression "element A is connected to element B" means that the element A is "directly" or "indirectly" connected to the element B via one or more other elements.

As used herein, the singular forms "a," "an," and "the" are intended to include the plural forms as well, unless expressly stated otherwise.

As used herein, the terms "comprising" and "including" specifically refer to the presence of the stated features, integers, steps, operations, elements and/or sections, but do not exclude the presence or addition of one or more other features, integers, steps, operations, elements, components, and/or combinations thereof.

Figure 1:
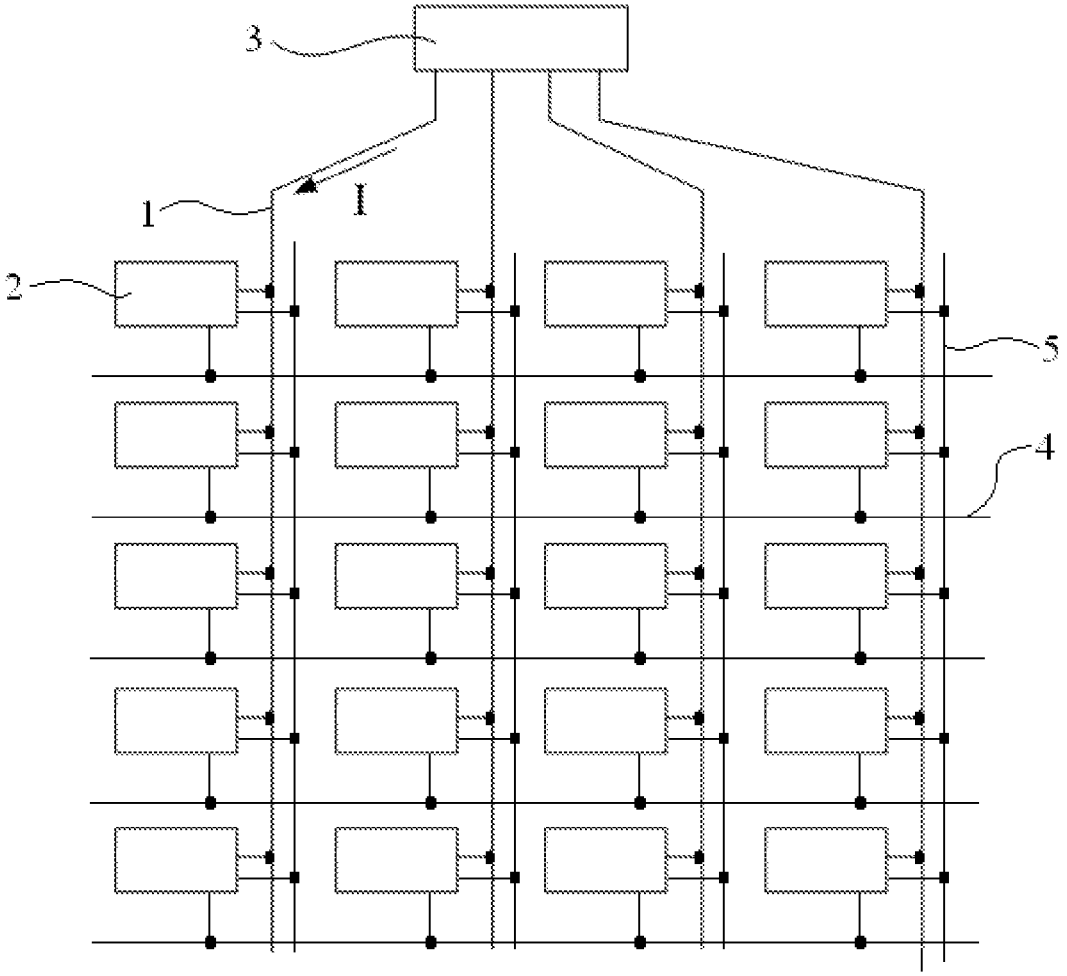
FIG. 1 is a schematic structural diagram of a display panel according to an embodiment of the disclosure.

FIG. 1 shows a schematic structural diagram of a display panel according to an embodiment of the disclosure. According to the embodiment of the present disclosure, the display panel may include any type of display panel. For convenience of description, the present disclosure is described below by taking an OLED display panel as an example, but this does not limit the scope of the present disclosure. As shown in FIG. 1, a plurality of power lines 1 are provided on the display panel. Each power line 1 is connected to a plurality of pixels 2, and one end of each power line 1 is connected to a power source 3. Those skilled in the art can understand that other functional modules may also be included on the display panel of FIG. 1.

An OLED is provided in each pixel 2, and the light emission of the OLED can be controlled for display. The power source 3 may be, for example, a driving chip and a power interface, and is configured to provide power to the OLEDs of the pixels 2 via the respective power lines 1.

Figure 2:
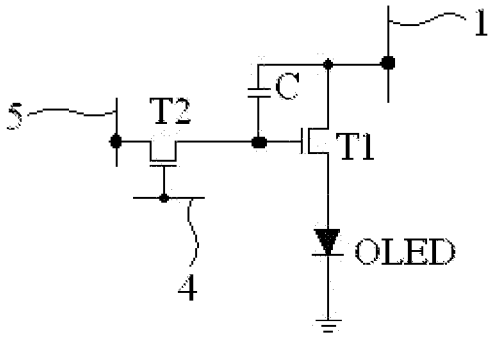
FIG. 2 is a circuit diagram of a pixel circuit of a display panel according to the embodiment of the present disclosure.

A pixel circuit may also be included in the pixel 2. FIG. 2 shows an exemplary circuit diagram of a pixel circuit. As shown in FIG. 2, the pixel circuit may include a driving transistor T1, a switching transistor T2 and a storage capacitor C. The switching transistor T2 is controlled to be turned on or turned off through the gate line 4. When the switching transistor T2 is turned on, the data voltage of the data line 5 is applied to the gate of the driving transistor T1 via the switching transistor T2. The gate-source voltage difference of the driving transistor T1 (i.e. the voltage difference between the gate and the source of the driving transistor T1) controls the current of the driving transistor T1 (i.e. the current between the source and the drain of the driving transistor T1), and then controls the current and light emission luminance of the OLED connected in series with the driving transistor T1. When the switching transistor T2 is turned off, the voltage of the gate of the driving transistor T1 can be maintained through the storage capacitor C, and light emission can be maintained.

In addition, the pixel circuit can also be implemented by other circuit structures, so that the data voltage can be applied to the gate of the driving transistor T1 to control the current of the OLED. It will not be described in detail herein.

The current of each OLED flows into the power line. The power line has a certain resistance. Therefore, there is an IR drop on the power line, and the voltages at respective positions of the power line are actually different. Specifically, the voltage on the power line farthest from the power source is lowest, and accordingly the actual power supply voltage supplied to the pixel is lowest. Although the luminance of the OLED is not determined by its power supply voltage, the current of the driving transistor is determined by its gate-source voltage. Since the source voltage is connected to the power supply voltage, when the power supply voltage changes (e.g. decreases), the current of the driving transistor will change accordingly, resulting in a change in the luminance of the pixel. Since the distances between different pixels and the power source are different, the changes in the power supply voltage in different pixels are also different, and the resulting luminance changes are also different. Therefore, the luminance of the OLED display panel at different positions is uneven (which does not indicate that the desired display luminance is different), thereby affecting display effects.

Figure 3:
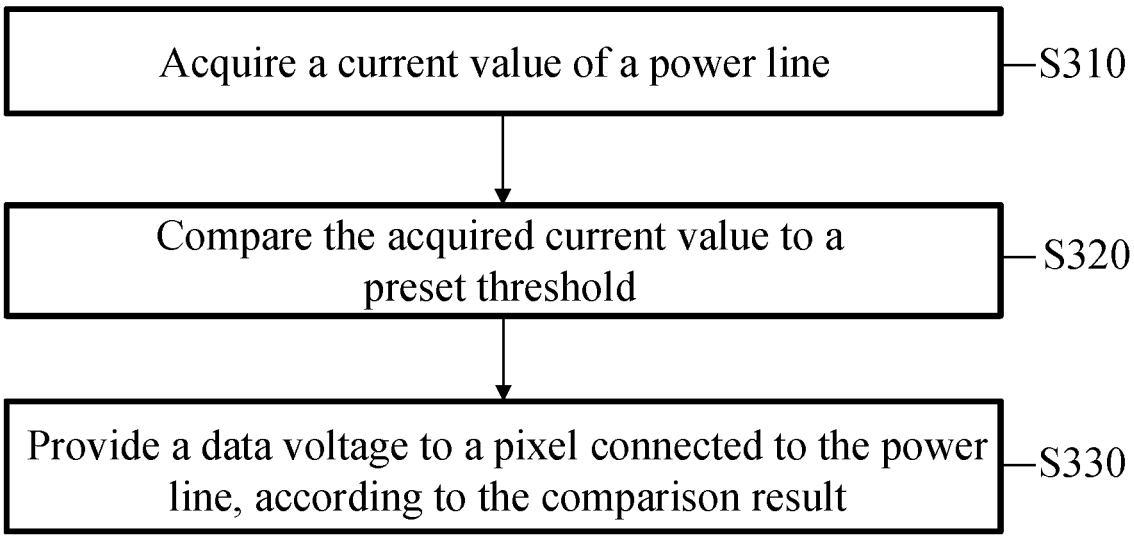
FIG. 3 is a flowchart of a method for driving a display panel according to the embodiment of the present disclosure.

FIG. 3 shows a flowchart of a method for driving the OLED display panel according to the embodiment of the present disclosure, including the following steps.

In step S310, the current value of the power line 1 is acquired. The current value is a value of current in a portion of the power line 1 between the power source 3 and the first pixel 2. The first pixel 2 is a pixel 2 closest to the power source 3 among all the pixels 2 connected to the power line 1.

In step S320, the acquired current value is compared with a preset threshold.

In step S330, a data voltage is supplied to the pixels 2 connected to the power line 1 according to the comparison result.

Specifically, when the current value of the power line 1 is less than or equal to the threshold, the original data voltage is provided to the pixels 2 connected to the power line 1. When the current value of the power line 1 is greater than the threshold, the compensation data voltage is provided to the pixels 2 connected to the power line 1. The compensation data voltage is equal to the difference between the original data voltage and the compensation voltage. In the case of the same current value, the compensation voltage corresponding to the pixel 2 with a greater equivalent distance is greater, wherein the equivalent distance is the distance from the pixel 2 along the track of the power line 1 connected thereto to the power source 3.

Since the current in each pixel 2 flows into the power line 1 from different positions, the currents at different positions of the power line 1 are actually different. The current of the power line portion which is closer to the power source is greater than the current of the power line portion which is farther to the power source. In the present embodiment, the current value used for comparison is the current in the portion of the power line 1 between the power source 3 and the first row of pixels 2, that is, the largest current in the power line 1, or the total current of all the pixels 2 connected to the power line 1.

Regardless of the voltage drop, the luminance of the pixel 2 is controlled by the data voltage supplied thereto by the data line 5. The original data voltage refers to the voltage which is supplied to the pixel 2 and directly corresponds to the luminance that should theoretically be displayed without considering the voltage drop.

The equivalent distance refers to the actual length of the power line 1 between the power source 3 and the connection of the pixel 2 with the power line 1, that is, the distance that the current flows in the power line 1 from the power source 3 to the pixel 2. Specifically, the distance is proportional to the voltage drop of the power line 1. Therefore, the change in the luminance of the pixel 2 and its corresponding equivalent distance are related to the current value of the power line 1.

Therefore, a threshold may be set in advance. When the current value (i.e. the maximum current abovementioned) of the power line 1 does not exceed the threshold, it indicates that the luminance of the pixel 2 connected to the power line 1 is relatively even, and no compensation is needed. When the current value in the power line 1 exceeds the threshold, it indicates that the luminance unevenness of the pixel 2 connected to the power line 1 is relatively serious and should be compensated. In this way, the original data voltage Vdata is no longer provided to the pixel 2 connected to the power line 1, but the compensation data voltage minus the compensation voltage $\Delta V$, $Vdata' = Vdata - \Delta V$, is supplied thereto.

Since the voltage drop of the voltage on the power line 1 is proportional to the equivalent distance, when the pixel 2 is compensated for, the corresponding compensation value of the pixel 2 corresponding to the greater equivalent distance should also be greater.

In the driving method of the display panel of this embodiment, the data voltage of the pixel 2 is compensated for when the current of the power line 1 is too large (that is, the luminance unevenness of the pixel 2 connected to the power line 1 is relatively obvious). Since the voltage drop of the power supply voltage of the pixel 2 which is farther from the power source 3 is greater, the actual data voltage is adjusted so that the compensation voltage corresponding to it increases. In this way, the actual luminance of the pixel 2 can be guaranteed to be basically unchanged, and luminance unevenness can be eliminated.

In an embodiment, the current value is the average value of the current in the portion of the power line 1 between the power source 3 and the first pixel 2 for one frame of a picture. Providing the original data voltage to the pixels 2 connected to the power line 1 includes providing the original data voltage to all the pixels 2 connected to the power line 1 for the next frame of the picture. Providing the compensation data voltage to the pixels 2 connected to the power line 1 includes providing the compensation data voltage to all the pixels 2 connected to the power line 1 for the next frame of the picture.

In the actual display, the adjacent frames of the picture usually have certain continuity, that is, the luminance (that is, the current value in the corresponding power line 1) of a certain part of a frame of a picture usually does not differ from the luminance of the same part for the previous frame of the picture too much. Therefore, the average current value of the power line 1 for the current frame of the picture can be used as the basis for judging whether or not to perform compensation for the next frame of the picture. If the average current value of a power line 1 for the current frame of the picture exceeds the threshold, the data voltage provided to all the pixels 2 connected to the power line 1 should be compensated for the next frame of the picture. Therefore, it can reduce the number of comparisons of the current.

In another embodiment, the current value is a real-time current value (i.e. the maximum current abovementioned) of the power line 1, and the pixels 2 connected to the same power line 1 are respectively connected to different gate lines 4. Providing the original data voltage to the pixels 2 connected to the power line 1 includes providing the original data voltage to the next pixel 2 connected to the power line 1. Providing the compensation data voltage to the pixels 2 connected to the power line 1 includes providing the compensation data voltage to the next pixel 2 connected to the power line 1.

In the OLED display panel, data voltages are sequentially provided to different pixels 2 through the scanning of the gate lines 4. If a plurality of pixels 2 connected to one power line 1 are connected to different gate lines 4, the data voltages of these pixels 2 are also provided at different timings. Therefore, the current value of the power line 1 can be detected in real time. According to the current value, it can be determined whether the compensation data voltage is provided to the next pixel 2 (i.e. the pixel 2 connected to the next scanned gate line 4). In this method, it can more accurately reflect whether the compensation is necessary.

The "acquisition of the current value of the power line 1" in the above description can be achieved by a certain means or can be achieved by a direct detection.

In an embodiment, the current value may be calculated based on the grayscale value of the pixel 2 connected to the power line 1.

When displaying, it firstly converts the information of an original image (i.e. the image to be displayed by the OLED display panel) into the grayscale value (or the luminance value) of each pixel 2 by the driving chip, where the grayscale value corresponds to the current value in the corresponding pixel 2. Therefore, at any moment, the grayscale values currently displayed by respective pixels 2 connected to a power line 1 are known, and the total current in these pixels 2, that is, the current value in the power line 1 (i.e. the maximum current abovementioned), can be calculated through these grayscale values. That is, the current value of the power line can be finally calculated based on the original image information.

On the other hand, the current value can also be obtained by a direct detection. That is, a detection module for detecting a current can be provided in each power line 1 or power source 3 so that the current in the power line 1 can be obtained by detection.

According to an embodiment of the present disclosure, the compensation voltage ΔVi corresponding to the pixel i can be calculated according to the following formula:

$$\Delta Vi = I \times di \times \rho / A$$

I is the current value of the power line 1 connected to the pixel i, di is the equivalent distance corresponding to the pixel i, p is the resistivity of the material of the power line 1, and A is the cross-sectional area of the power line 1.

The current flowing through the driving transistor T1 can be obtained by the following formula: $I=K\times(VDD-Vdata)^2$, where K is a constant related to the material structure of the driving transistor T1, VDD is a power supply voltage, and Vdata is a data voltage. That is, in the pixel i, the current flowing through the driving transistor T1 of the i-th pixel is proportional to $(VDDi-Vdatai)^2$, where VDDi is the actual power supply voltage of the pixel i, and Vdatai is the data voltage of the pixel i.

When a voltage drop occurs, the actual power supply voltage VDDi decreases, so the data voltage Vdatai should also be reduced, respectively, to the same degree, to ensure that the value of $(VDDi-Vdatai)^2$ does not change. The decrease in the power supply voltage VDDi is the voltage drop equal to I×Ri, and Ri is the resistance of the power line 1 between the pixel i and the power source 3. According to the resistance calculation formula, known as $Ri=di\times\rho/A$, the compensation voltage ΔVi could be calculated.

In one embodiment, the power lines 1 are arranged along the column direction, and the pixels 2 connected thereto are located in a plurality of different rows. The compensation voltage ΔVi corresponding to the pixel i is calculated according to the following equation: $\Delta Vi=I\times[R1+\Delta R\times(n-1)]$, where I is the current value of the power line 1 connected to the pixel i, R1 is the resistance of the power line 1 between the first row of pixels 2 and the power source 3, ΔR is the resistance of the power line 1 between two adjacent rows of pixels 2, and n is the serial number of the row where the pixel i is located.

In general, the distance between any two adjacent rows is the same, and therefore, if the power line 1 is arranged along the column direction as shown in FIG. 1, whenever one row is added, the resistance of the power line 1 increases by a certain amount ΔR. Therefore, the total resistance of the power line 1 corresponding to the nth row of pixels 2 should be equal to $R1+\Delta R\times(n-1)$, so the compensation voltage ΔVi at this time can be calculated by the above formula.

It should be understood that the currents at different positions in the power line 1 are actually different, and the above calculations are performed with the maximum current therein. This is an approximate manner adopted to simplify the calculation process, but does not affect the implementation of the present disclosure.

Apparently, the above description merely relates to part of specific examples of the compensation voltage calculation method, and is not a limitation on the protection scope of the present disclosure.

According to an embodiment of the present disclosure, there is further provided a display panel. The display panel includes a plurality of power lines 1, each of which is connected to a plurality of pixels 2, and one end of which is connected to a power source 3. In addition, the display panel further includes a current acquisition unit, a comparison unit, and a data voltage supply unit.

The current acquisition unit is configured to acquire the current value of the power line 1. The current value is the value of current in the portion of the power line 1 between the power source 3 and the first pixel 2. The first pixel 2 is the pixel 2 closest to the power source 3 among all the pixels 2 connected to the power line 1.

The comparison unit is configured to compare the current value with a preset threshold.

The data voltage supply unit is configured to provide the data voltage to the pixels 2 connected to the power line 1 according to the comparison result. Specifically, when the current value in the power line 1 is less than or equal to the threshold, the original data voltage is provided to the pixels 2 connected to the power line 1. When the current value in the power line 1 is greater than the threshold, the compensation data voltage is provided to the pixel 2 connected to the power line 1. The compensation data voltage is equal to the difference between the original data voltage and the compensation voltage. In the case of the same current value, the compensation voltage corresponding to the pixel 2 with a greater equivalent distance is greater. The equivalent distance is the distance from the pixel 2 along the track of the power line 1 connected thereto to the power source 3.

In the embodiment of the present disclosure, the current value is the average value of the current in the portion of the power line 1 between the power source 3 and the first pixel 2 for one frame of a picture. When the current value in a power line 1 is less than or equal to the threshold, the data voltage supply unit is configured to provide the original data voltage to all the pixels 2 connected to the power line 1 for the next frame of the picture. When the current value in the power line 1 is greater than the threshold, the data voltage supply unit is configured to provide the compensation data voltage to all the pixels 2 connected to the power line 1 for the next frame of the picture.

In the embodiment of the present disclosure, the current value is a real-time current value in the power line 1, and respective pixels 2 connected to a power line 1 are connected to different gate lines 4, respectively. When the current value of the power line 1 is less than or equal to the threshold, the data voltage supply unit is configured to provide the original pixel voltage to the next pixel 2 connected to the power line 1. When the current value of the power line 1 is greater than the threshold, the data voltage supply unit is configured to provide a compensation data voltage to the next pixel 2 connected to the power line 1.

In an embodiment of the present disclosure, the current acquisition unit may include a current calculation module or a current detection module. The current calculation module is configured to calculate the current value based on the grayscale value of the pixel 2 connected to the power line 1. The current detection module is configured to detect the current value of the power line 1.

The display panel of this embodiment can perform the above driving method, so it can reduce the display unevenness.

Specifically, the display panel may be any product or component that has a display function, such as an electronic paper, a mobile phone, a tablet computer, a television, a display, a notebook computer, a digital photo frame, a navigator, and the like.

A unit or module described herein may be implemented as a combination of a processor and a memory, where the processor executes a program stored in the memory to implement the function of the corresponding unit or module. The unit or module described herein may also be implemented in a complete hardware implementation including an application specific integrated circuit (ASIC), a field programmable gate array (FPGA), and the like.

It can be understood that the above embodiments are merely exemplary embodiments employed for illustrating the principle of the present disclosure, but the present disclosure is not limited thereto. For a person of ordinary skill in the art, various variations and improvements can be made without departing from the spirit and essence of the present disclosure, and these variations and improvements are also considered to be within the protection scope of the present disclosure.

What is claimed is:

1. A method for driving a display panel, the display panel comprising a plurality of power lines, each power line connecting to a plurality of pixels, and one end of each power line connecting to a power source, wherein the method for driving the display panel comprises: acquiring a current value of a power line of the plurality of power lines, wherein the current value is a value of current in a portion of the power line between the power source and a first pixel, which is a closest pixel to the power source among all pixels connected to the power line: comparing the acquired current value to a preset threshold; and providing an original data voltage to the pixels connected to the power line when the current value of the power line is less than or equal to the threshold, and providing a compensation data voltage to the pixels connected to the power line when the current value of the power line is greater than the threshold; wherein the compensation data voltage is equal to the difference between the original data voltage and a compensation voltage; and wherein for the same current value, the compensation voltage corresponding to a pixel with a greater equivalent distance, which is a distance from the pixel along the track of the power line connected thereto to the power source, is greater.

2. The method for driving a display panel according to claim 1, wherein the current value is an average value of the current in a portion of the power line between the power source and the first pixel for a frame of a picture;

wherein providing the original data voltage to the pixels connected to the power line comprises providing the original data voltage to all pixels connected to the power line for a next frame of the picture; and wherein providing the compensation data voltage to the pixels connected to the power line comprises providing the compensation data voltage to all pixels connected to the power line for the next frame of the picture.

3. The method for driving a display panel according to claim 1, wherein the current value is a real-time value of current in the power line, and the pixels connected to the power line are respectively connected to different gate lines;

wherein providing the original data voltage to the pixels connected to the power line comprises providing the original data voltage to a next pixel connected to the power line; and wherein providing the compensation data voltage to the pixels connected to the power line comprises providing the compensation data voltage to the next pixel connected to the power line.

4. The method for driving a display panel according to claim 1, wherein one of i) the current value is calculated based on a grayscale value of the pixel connected to the power line, and ii) the current value is obtained by detection.

5. The method for driving a display panel according to claim 1, wherein the compensation voltage ΔVi corresponding to the pixel i is calculated according to the following equation:

$$\Delta Vi = I \times di \times \rho / A,$$

wherein I is the current value of the power line connected to the pixel i, di is the equivalent distance corresponding to the pixel i, p is the resistivity of a material of the power line, and A is cross-sectional area of the power line.

6. The method for driving a display panel according to claim 1, wherein the power line is arranged in a column direction, and the pixels connected thereto are located in a plurality of different rows; and wherein the compensation voltage ΔVi corresponding to the pixel i is calculated according to the following equation:

$$\Delta Vi = I \times [R1 + \Delta R \times (n-1)],$$

wherein 1 is the current value of the power line connected to the pixel i, R1 is the resistance of the power line between a first row of pixels and the power source, ΔR is a resistance of the power line between two adjacent rows of pixels, and n is a serial number of the row of the pixel i.

7. A display panel comprising: a plurality of power lines, each power line connecting a plurality of pixels, one end of each power line connected to a power source; a current acquisition unit configured to acquire a current value of a power line of the plurality of power lines, wherein the current value is a value of current in a portion of the power line between the power source and a first pixel, which is a closest pixel to the power source among all pixels connected to the power line: a comparison unit configured to compare the acquired current value to a preset threshold; and a data voltage supply unit configured to provide an original data voltage to the pixels connected to the power line when the current value of the power line is less than or equal to the threshold, and provide a compensation data voltage to the pixels connected to the power line when the current value of the power line is greater than the threshold; wherein the compensation data voltage is equal to the difference between the original data voltage and a compensation voltage; and wherein for the same current value, the compensation voltage corresponding to a pixel with a greater equivalent distance, which is a distance from the pixel along the track of the power line connected thereto to the power source, is greater.

8. The display panel according to claim 7, wherein the current value is an average value of the current in a portion of the power line between the power source and the first pixel for a frame of a picture;

wherein the data voltage supply unit is configured to provide the original data voltage to all pixels connected to the power line for a next frame of the picture when the current value of the power line is less than or equal to the threshold; and wherein the data voltage supply unit is configured to provide the compensation data voltage to all pixels connected to the power line for the next frame of the picture when the current value of the power line is greater than the threshold.

9. The display panel according to claim 7, wherein the current value is a real-time value of current in the power line, and the pixels connected to the power line are respectively connected to different gate lines;

wherein the data voltage supply unit is configured to provide the original data voltage to a next pixel connected to the power line when the current value of the power line is less than or equal to the threshold; and wherein the data voltage supply unit is configured to provide the compensation data voltage to the next pixel connected to the power line when the current value of the power line is greater than the threshold.

10. The display panel according to claim 7, wherein the current acquisition unit comprises one of:

a current calculation module configured to calculate the current value based on a grayscale value of the pixel connected to the power line; and a current detection module configured to detect the current value of the power line.

* * * * *